United States Patent [19]

Peterson

[11] 4,058,383

[45] Nov. 15, 1977

[54] METHOD OF AND APPARATUS FOR CLEANING THE ICEMAKER OF A CARBONATED BEVERAGE DISPENSING MACHINE

[75] Inventor: LeRoy Peterson, Hoffman Estates, Ill.

[73] Assignee: Reynolds Products Inc., Schaumburg, Ill.

[21] Appl. No.: 632,216

[22] Filed: Nov. 17, 1975

[51] Int. Cl.[2] .....F25B 47/00; F25C1/00; F25D 3/12; B67D 5/62

[52] U.S. Cl. ..... 62/85; 62/303; 62/348; 62/388; 62/392; 222/148

[58] Field of Search ..... 62/85, 303, 348, 354, 62/306, 388, 392; 222/148; 134/95, 10 B

[56] References Cited

U.S. PATENT DOCUMENTS

| | | | |
|---|---|---|---|
| 2,270,383 | 1/1942 | Norton et al. | 62/303 |
| 2,583,982 | 1/1952 | Zwosta et al. | 62/303 |
| 2,961,853 | 11/1960 | Cohrt | 62/303 |
| 3,273,585 | 9/1966 | Patch | 62/303 |
| 3,359,748 | 12/1967 | Booth | 62/306 |
| 3,369,376 | 2/1968 | Kious | 62/303 |
| 3,400,551 | 9/1968 | Booth et al. | 62/306 |
| 3,468,137 | 9/1969 | Welty | 62/306 |
| 3,638,448 | 2/1972 | Raymer | 62/303 |
| 3,733,840 | 5/1973 | Pearl et al. | 62/303 |
| 3,939,667 | 2/1976 | Halverson | 62/306 |
| 3,945,536 | 3/1976 | Doak | 222/148 |

*Primary Examiner*—Lloyd L. King
*Attorney, Agent, or Firm*—Shenier & O'Connor

[57] ABSTRACT

A method of and apparatus for cleaning the icemaker of a beverage dispensing machine having a carbonator in which carbonated water is introduced into the icemaker and into the water feeder tank and is allowed to stand for a period of time sufficient to dissolve or loosen bacterial slime and accumulated lime, after which time the carbonated water is drained and the system is flushed with still water. In one embodiment of the invention the feeder tank and icemaker are drained and carbonated water is introduced. In another embodiment carbon dioxide from the carbonator is introduced directly into the water in the icemaker and water feeder tank.

7 Claims, 4 Drawing Figures

METHOD OF AND APPARATUS FOR CLEANING THE ICEMAKER OF A CARBONATED BEVERAGE DISPENSING MACHINE

BACKGROUND OF THE INVENTION

My invention relates to a method and apparatus for cleaning icemakers provided in carbonated beverage dispensers. Most cold drink machines of the prior art which are adapted to dispense both plain and carbonated beverage are provided with automatic icemakers. Most of the icemakers are of the type in which cold water from the machine supply is fed to a chamber having a freezing surface from which ice crystal are scooped and forced through a relatively restricted passage to form relatively clear ice, chunks or pieces of which are fed to a storage chamber. When the supply of ice in the storage chamber reaches a predetermined level the icemaker shuts off and water is permitted to stand in the icemaker and feed line. One of the problems encountered in connection with such icemakers has been the tendency for bacterial and mineral residues to form in the water owing to stagnation. While the bacterial growth is ordinarily not physically harmful, the slime which is formed makes the ice esthetically objectionable. Both the bacterial and the mineral residue may also cause "soft ice," clogging, or other mechanical problems. Systems which draw off all or part of the melted-down water and use it in the carbonator system, and thus minimize the chances for stagnation, have not wholly solved the problem.

There are known in the prior art methods for cleaning icemakers which contemplate flowing hot water or a phosphoric acid solution through the icemaker. These methods, however, are not automatic. Moreover, they require an additional chemical supply system or a source of hot water adding to the complexity and cost of the total machine.

SUMMARY OF THE INVENTION

One object of my invention is to provide a method of and apparatus for cleaning the icemaker of a carbonated beverage dispenser.

Another object of my invention is to provide a method of and apparatus for automatically cleaning the icemaker of a carbonated beverage dispenser which includes a source of carbonated water.

A further object of my invention is to provide a method of and apparatus for cleaning the icemaker of a carbonated beverage dispenser which do not require an auxiliary source of a cleaning medium.

Yet another object of my invention is to provide apparatus for cleaning the icemaker of a carbonated beverage dispenser which is simple in construction and in operation.

A still further object of my invention is to provide apparatus for cleaning the icemaker of a carbonated beverage dispenser which is relatively inexpensive.

Other and further objects of my invention will appear from the following description:

In general, my invention contemplates a method for cleaning the icemaker of a carbonated beverage dispenser having a carbonator in which I first fill the icemaker with carbonated water from the carbonator, then allow the carbonated water to stand in the icemaker for a predetermined period of time sufficient to dissolve accumulated minerals and slime, and then flush the carbonated water out of the icemaker with still water.

In an alternative method, I introduce carbon dioxide gas from the carbon dioxide supply directly into the existing water in the icemaker, thus forming the carbonated water in the icemaker itself.

My invention also contemplates the provision of apparatus for automatically performing my method. In the first embodiment of my apparatus carbonated water is drawn from the carbonator to fill the icemaker. I connect the drain of the icemaker, from which melted-down water is allowed to run off, to a collecting drain by means of a first pipe which is controlled by a first valve. I also connect the water inlet of the icemaker, which normally receives tap water through an inlet water valve, to the carbonated water outlet of the carbonator by means of a second pipe flow through which is controlled by a second valve. I further provide a control timer which, in sequence closes the water inlet valve and opens the first valve to drain the water from the icemaker, closes the first valve and opens the second valve to fill the icemaker with carbonated water, closes the second valve, allows approximately thirty minutes to elapse, reopens the first valve to drain the carbonated water from the icemaker, reopens the water inlet valve to flush the carbonated water from the icemaker, and then recloses the first valve to complete the cycle. With respect to the second method, in which the water is carbonated in the icemaker itself, I connect the drain of the icemaker to a first pipe flow through which is controlled by a first valve, as before, but connect the water inlet to the existing supply of carbon dioxide gas through a second pipe in response to operation of a second valve. I provide a control timer which operates substantially the same as in the first embodiment, but, instead of opening the first valve to drain the icemaker and then opening the second valve to admit carbonated water, simply opens the second valve to admit carbon dioxide gas to the icemaker where it mixes with the existing tap water to form carbonated water.

The carbonated water which is provided to the icemaker by the above methods and apparatus serves both to control bacterial growth and to reduce mineral deposits, thereby minimizing the problems referred to above. Moreover, the cleaning cycle is performed automatically by the apparatus described and without requiring an auxiliary chemical or hot water supply. By utilizing the existing supply of carbonated water or carbon dioxide gas, as the case may be, I achieve an effective and economical solution to the problems incident to bacterial and mineral build-up in the icemaker.

BRIEF DESCRIPTION OF THE DRAWINGS

In the accompanying drawings to which reference is made in the instant specification and in which like reference characters are used to indicate like parts in the various views.

DESCRIPTION OF THE PREFERRED EMBODIMENT

Figure 1:
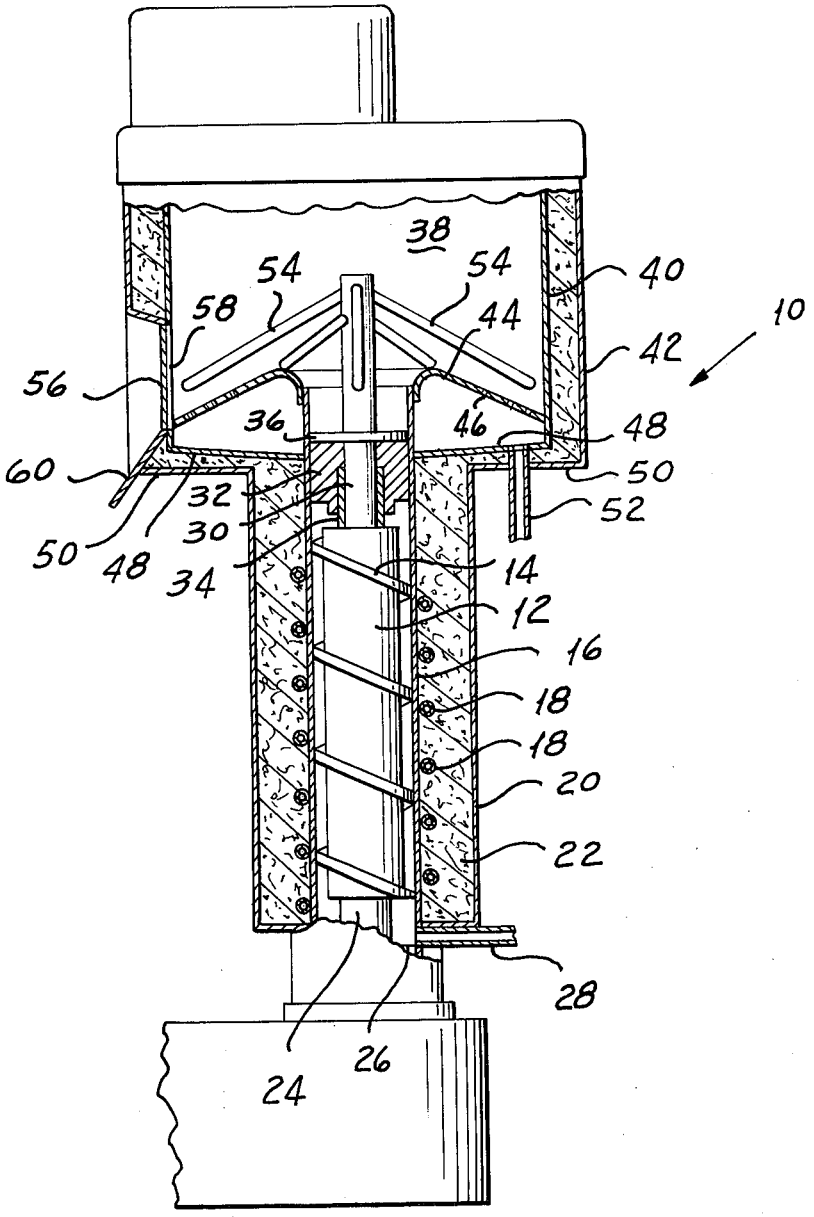
FIG 1 PRIOR ART
FIG. 1 is an elevation, of one form of icemaker, with parts broken away and into other parts shown in sections, to which my method of an apparatus for cleaning the icemaker of a carbonated beverage dispenser may be applied.

Referring now to FIG. 1, one form of icemaker, indicated generally by the reference numeral 10, with which my cleaning arrangement can be used, includes an auger 12 having a helical blade 14 and disposed within a refrigerating cylinder 16. The cylinder 16 is surrounded by a refrigerating coil 18, through which a suitable refrigerant is pumped. The inner refrigerating cylinder 16 is thermally insulated from the outer cylindrical wall 20 by an insulating material 22. The auger 12 has a lower shaft portion 24 which extends through an airtight seal 26 and which is coupled to a motor (not shown). An inlet pipe 28, leading into cylinder 16 adjacent to the bottom thereof supplies fresh water to the icemaker 10.

Ice crystals formed on the inner surface of the wall of the cylinder 16 are scraped off the surface by blade 14 and the resultant slush ice is moved upward by rotation of the auger 12 toward an extruding head 32 fixedly arranged within the cylinder 16 above the auger 12. Slush ice forced upwardly by the auger 12 moves into a restricted passage in head 32 to form relatively hard ice. A pilot bearing 34 in head 32 receives the upper shaft portion 30. A cutter 36, mounted on the upper shaft portion 30 just above the extruding head 32, cuts the ice as it is forced upward through the head 32. After it has been formed and cut, the ice is pushed upward into a storage area 38 in a reservoir formed by a cylindrical inner wall 40 and a bottom 48. An outer skin made up of a circular wall 42 surrounding wall 40 and by a bottom 50 extending outwardly from the upper end of wall 20 retains insulating material around the ice reservoir. A platform 44 supporting the ice in area 38 above bottom 48 is formed with a plurality of holes 46 and extends downwardly from the top edge of the cylinder 16 to the inner wall 40. Water formed by the melting of the ice in the storage area 38 runs through the holes 46 into the area below the perforated wall 44, where it is collected by a melt-down water outlet 52. A plurality of arms 54 radiating from the shaft upper portion 30 continually agitate the ice to prevent the chunks from forming a solid block of ice. Ice is dispensed when a beverage is sold through a discharge opening 58 located on the inner wall 40 and down a discharge chute 60. The discharge opening is normally sealed by a door 56. The structure thus far described is well known in the art.

Figure 2:
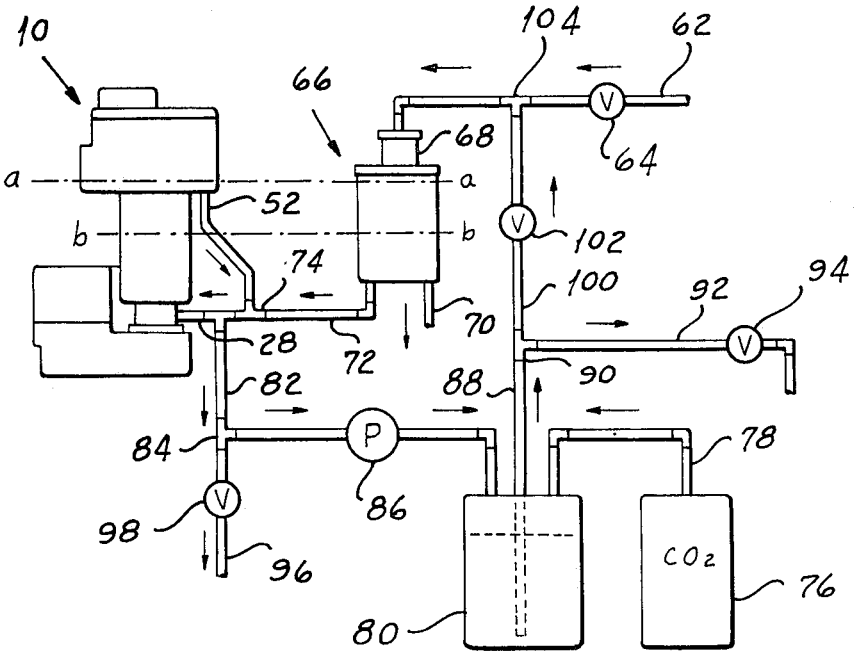
FIG. 2 is a schematic view of one form of my apparatus for practising my method of cleaning the icemaker of a carbonated beverage dispenser.

Referring now to FIG. 2 of the drawings, in one form of my apparatus for cleaning the icemaker 10, the carbonated beverage dispensing machine includes a line 62 leading from a supply of still water and adapted to be connected by a normally closed valve 64 to an air gap 68 leading into the still water supply tank indicated generally by the reference character 66 of the dispenser system. As is known in the art, the tank 66 includes an overflow line 70 in the event that the water level control system to be described fails. An outlet line 72 from the tank 66 is connected by a tee 74 to the inlet 28 of the icemaker. In addition, the melt-down outlet line 52 is connected to the tee 74.

The dispenser includes a supply tank 76 holding a supply of carbon dioxide adapted to be fed by a line 78 to the carbonated water supply tank 80 of the dispenser. The carbonated water supply tank 80 is provided with a suitable liquid level control (not shown) known to the art. A line 82 leading from line 28 is connected by a tee 84 to the inlet of a pump 86 adapted to supply water to the tank 80. A carbonated water outlet line 88 is connected by a tee 90 to a carbonated water supply line 92 adapted to be connected by a valve 94 to a nozzle or the like (not shown) leading to the cup which is adapted to receive the beverage.

The structure thus far described is known in the art. In the form of my arrangement shown in FIG. 2 for cleaning the icemaker 10 and the water supply tank 66, a normally closed valve 98 is adapted to be opened to connect the system to a line 96 leading to a waste tank or the like (not shown) to drain the system. As will more fully be described hereinbelow, after the system has been drained and with the valves 64 and 98 closed, a valve 102 connected by a line 100 to the tee 90 and adapted to be connected into the supply line to the tank 66 by a tee 104 is opened for a period of time sufficient to supply carbonated water from line 88 to the tank 66 and to the icemaker 10 to a level indicated by the dot-dash line a-a in FIG. 2, which is very close to the top of the tank 66 and which is above the melt-down water outlet of the icemaker storage chamber.

After the tank and the icemaker have been filled with carbonated water to the level of line a-a, valve 102 is closed and the carbonated water is allowed to stand for a period of time sufficient to permit the carbonated water to break down the bacterial deposit and lime in the tank, the icemaker and the feed line. For example, I have discovered that in the installation illustrated in the drawings, a period of time of about 30 minutes is sufficient effectively to clean the system. After this period of time valve 98 is opened to permit the carbonated water containing the broken down bacterial deposits and lime to flow to the waste tank through line 96. Following that operation, the still water inlet valve 64 can be opened to flush the system.

Figure 4:
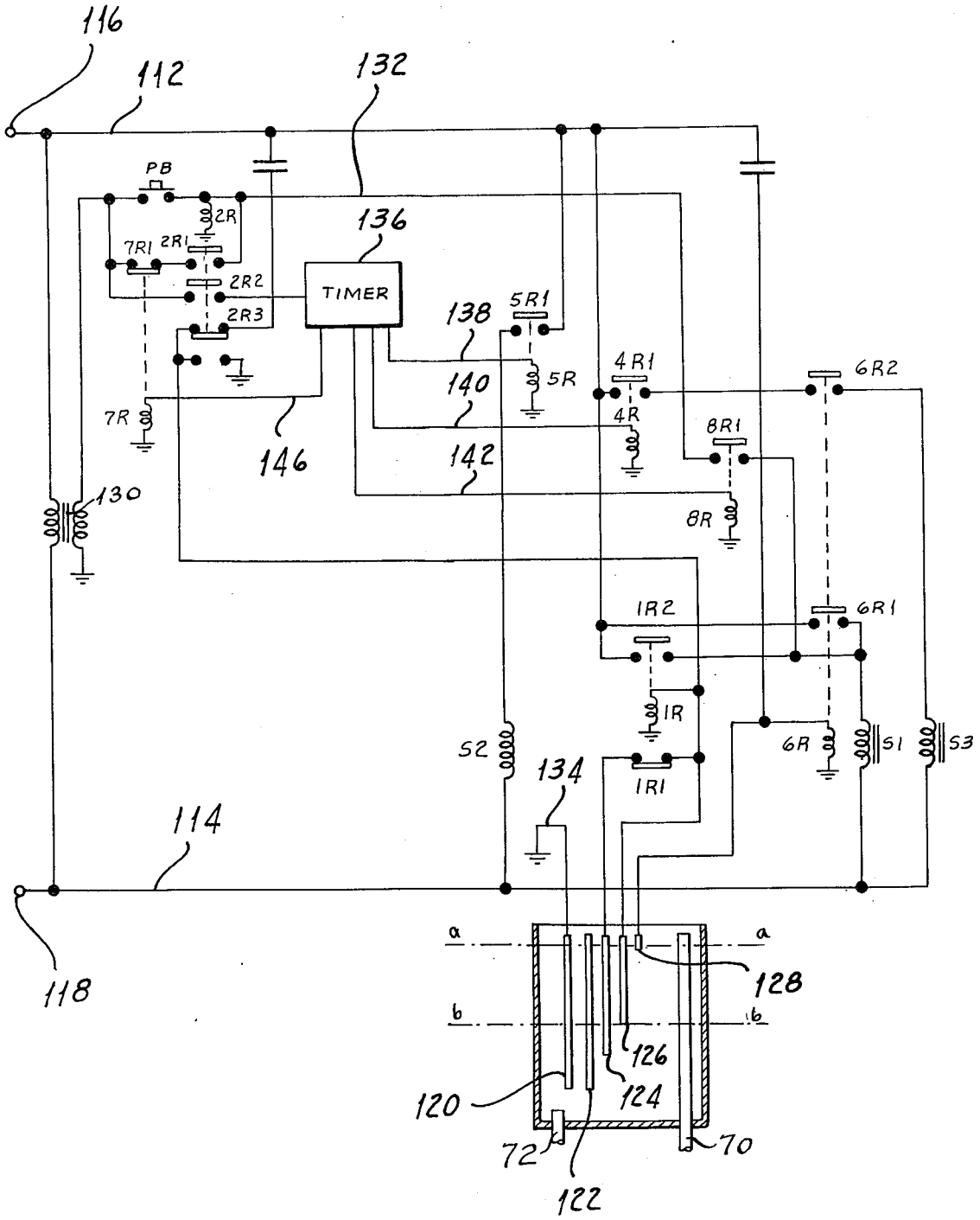
FIG. 4 is a schematic view of one form of control circuit which can be used to control my apparatus for cleaning the icemaker of a carbonated beverage dispenser.

Referring now to FIG. 4, I have shown one form of electrical circuit which may be employed to control the the operation of my cleaning system. Respective conductors 112 and 114 connected to the terminals 116 and 118 of a suitable source of alternating current potential provide power for the system. In the liquid level control illustrated in FIG. 4, the tank 66 is provided with electrodes 120, 122, 124, 126 and 128. Electrode 120 extends downwardly into the tank to a level adjacent to the bottom thereof. A conductor 134 connects electrode 120 to ground. The electrode 122 which extends downwardly into the tank for substantially the same distance as does electrodes 120 can be used to disable the dispenser in the event that the supply of water in the tank 66 falls to a level below the two electrodes 120 and 122. Since the arrangement per se does not form a part of my invention, it will not be described in detail. Electrodes 124 and 126 are provided to control the normal level of liquid in the system to a level indicated by the dot-dash line *b—b* in FIG. 4.

A transformer 130 couples power from lines 112 and 114 to a conductor 132 of the liquid level control portion of the circuit shown in FIG. 4. In the arrangement shown, a control relay winding 1R is connected by normally closed switch contacts 2R3 and a capacitor to line 132. Electrode 126 which extends downwardly into the tank to the level of line *b—b* is also connected to the contacts 2R2. Electrode 124 is connected by normally closed relay contacts 1R1 to the common terminal of winding 1R and electrode 126. It will readily be appreciated from the arrangement shown that with either of the electrodes 124 or 126 in conductive relationship with water in the tank 66 and with contacts 1R1 closed, the upper terminal of relay winding 1R will be shorted to ground through the water and through electrode 120, so that the winding is deenergized. When, however, the level of water in the tank 66 drops to below the electrode 124, winding 1R is no longer shorted to ground so that the winding is energized. When energized, winding 1R closes contact 1R2 to complete the circuit from line 112 to a solenoid S1 associated with valve 64 which opens the valve to cause tap water to flow into the tank 66. At the same time, winding 1R opens contacts 1R1. As water flows into the tank so that the level of water therein rises, electrode 124 is first covered. This, however, will not deenergize winding 1R since contacts 1R1 are now open. When, however, the level of water within the tank reaches electrode 126, the upper terminal of winding 1R is grounded and the relay is deenergized so that contacts 1R open to deenergize solenoid S1 to permit valve 64 to close and to close contacts 1R1. Thus it will be apparent that electrode 124 and 126 normally prevent the level of water in the tank 66 from falling below a level at the bottom of electrode 124 and from rising above a level over the lower end of electrode 126. The operation of these electrodes likewise is known in the art.

In my arrangement for cleaning the icemaker 10 and the tank 66 to initiate a cleaning operation, a push-button PB is operated to energize a relay winding 2R. Winding 2R first closes normally opens switch contacts 2R1 to complete its own holding circuit through normally closed contacts 7R1. In addition, energization of winding 2R closes contact 2R2 to supply power to a timer circuit 136. Circuit 136 may be of any suitable type known to the art, which in a preset order and for predetermined periods of time provides outputs on respective lines 138, 140, 142 and 144 and which at the end of its operation momentarily produces an output signal on a line 146. In addition to closing switch contacts 2R1 and 2R2 energization of relay winding 2R moves switch contacts 2R3 to a position at which they connect the upper terminal of relay winding 1R to ground to deactivate the normal water level control during the period of the cleaning operation.

After operation of the system is initiated, timer 136 first puts out a signal on line 138 to energize a winding 5R to close switch contacts 5R1 to energize a solenoid winding S2 associated with the drain valve 98. In this manner the system is first drained of water. It will be remembered that valve 64 is closed at this time since contacts 2R3 ground the upper terminal of winding 1R. After a period of time sufficient to ensure draining of the system, the signal on line 138 disappears so that winding 5R is deenergized, contacts 5R1 open and solenoid S2 is deenergized to permit the valve 98 to close.

After draining of the system, timer 136 puts out a signal on line 140 to energize a winding 4R to close contacts 4R1. As has been explained hereinabove, I provide an electrode 128 adjacent to the top of tank 66. This electrode is connected to the upper terminal of a relay winding 6R, the lower terminal of which is grounded. A capacitor connects the upper terminal of winding 6R to the line 132. It will be appreciated that so long as conductive liquid is out of engagement with electrode 128, winding 6R is energized to close contacts 6R1 and 6R2. Thus, after the tank has been drained and when the signal on line 140 energizes winding 4R to close contacts 4R1, a circuit is complete through contacts 4R1 and 6R2 to a solenoid S3 associated with valve 102 to open the valve to cause carbonated water from the supply tank 80 to flow into the icemaker water supply tank 66 and into the icemaker 10. When this carbonated water reaches the level of electrode 128, the electrode is connected to ground through electrode 120 to short winding 6R to cause the winding to be deenergized, so that contact 6R2 open and deenergize solenoid S3 to cut off the flow of carbonated water to the tank 66 and to the icemaker 10.

Following a period of time sufficient to permit the carbonated water to break down accumulated bacterial slime and lime from the tank 66, the feed line 72, line 52, inlet 28 and the interior of the icemaker, timer 136 again puts out a signal on line 138 for a period of time sufficient to permit the icemaker to drain. Next, the timer puts out a signal on a line 142 to energize a winding 8R to close contacts 8R1 again to energize S1 through the now closed contacts 6R1 to fill the icemaker with still water up to the level of electrode 128. Again, the timer puts out a signal on line 138 for a period of time sufficient to drain the icemaker. At the end of its cycle of operation, timer 136 puts out a signal on line 146 to energize winding 7R to open contacts 7R1 to deenergize relay 2R at the end of the cleaning operation.

Figure 3:
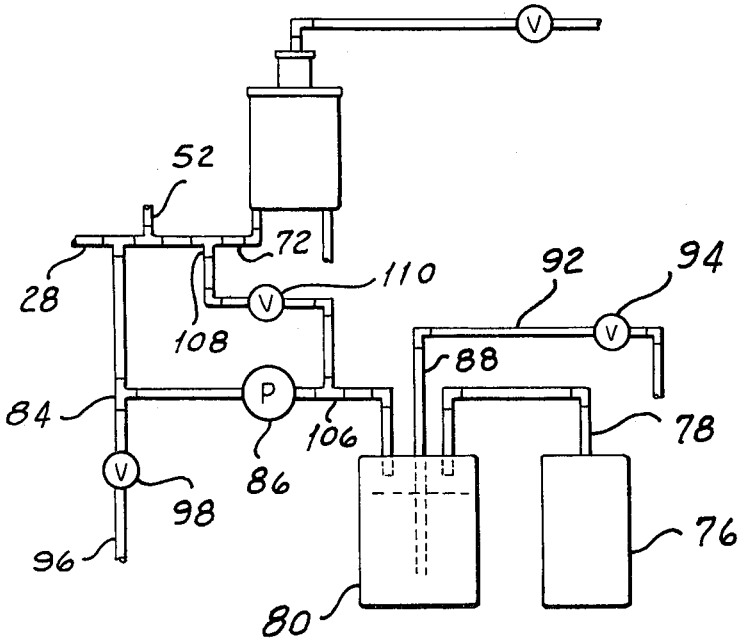
FIG. 3 is a schematic view of an alternate form of my apparatus for practising my method of cleaning the icemaker of a carbonator beverage dispenser.

Referring now to FIG. 3, in an alternate embodiment of my apparatus for cleaning the icemaker 10, rather than supplying the icemaker 10 and supply tank 66 with carbonated water from the tank 80, I directly inject carbon dioxide into the water already in the icemaker. I accomplish this result by means of a valve 110 connected into the line between pump 86 and the tank 80 by a tee 106 and into the line 72 by a tee 108. It will be seen that in this system, I do away with the necessity of first flushing the tank.

The operation of my method of an apparatus for cleaning an icemaker of a carbonated beverage dispenser will readily be apparent from the description hereinabove. In practice of the method and in operation of the apparatus, the icemaker and its associated water supply tank, first are filled to a predetermined level with carbonated water. This carbonated water is permitted to stand in the system for a period of time, such for example as thirty minutes, sufficient to permit it to break down accumulated bacterial slime and lime. After that period of time, the system is flushed by draining the icemaker and tank and by supplying the system with still water.

It will be seen that I have accomplished the objects of my invention. I have provided a method of an apparatus for cleaning the icemaker of a carbonated beverage dispensing machine. My method of an apparatus for cleaning, does away with the necessity of providing a separate source of a chemical cleaner or of hot water. By use of my apparatus, the cleaning operation is automatically performed. It is relatively simple in practice and is easy to install. It is inexpensive both in terms of labor and in apparatus for the result achieved thereby.

It will be understood that certain features and subcombinations are of utility and may be employed without reference to other features and subcombinations. This is contemplated by and is within the scope of my claims. It is further obvious that various changes may be made in details within the scope of my claims without departing from the spirit of my invention. It is, therefore, to be understood that my invention is not to be limited to the specific details shown and described.

Having thus described my invention, what I claim is:

1. A method of cleaning the icemaker and icemaker water feeder tank of a carbonated beverage dispenser having a carbonated water supply, said feeder tank normally supplying said icemaker with still water to a first level, said icemaker having an ice storage chamber with a melt-down outlet at a second level above said first level, including the steps of supplying carbonated water to said feeder tank and to said icemaker, retaining said carbonated water in said feeder tank and in said icemaker for a period of time sufficient substantially to remove accumulated deposits therefrom, and then removing said carbonated water from said icemaker and said feeder tank.

2. A method as in claim 1 in which said step of supplying said carbonated water comprises filling said icemaker and said feeder tank to a level above said first level.

3. A method as in claim 1 in which said step of supplying carbonated water comprises filling said feeder tank and said icemaker to a level above said second level.

4. A method as in claim 1 including the step of flushing said icemaker and said feeder tank with still water following the removal of said carbonated water.

5. Apparatus for cleaning the icemaker and icemaker water feeder tank of a carbonated beverage dispenser having a source of still water and a carbonated water supply system provided with a carbonated water supply tank, said feeder tank normally supplying said icemaker with still water up to a predetermined level, including in combination a first valve connecting said source of still water to said feeder tank, means for supplying said icemaker and said feeder tank with carbonated water from said supply system up to at least said predetermined level, said supplying means comprising a second valve connecting said carbonated water supply system to said icemaker and feeder tank, a drain line, normally inoperative means connecting said drain line to said icemaker and feeder tank, and control means for sequentially closing said first valve to disconnect said feeder tank from said source of still water, opening said second valve to connect said carbonated water supply system to said icemaker and feeder tank, and then rendering said drain line connecting means operative to drain said icemaker and feeder tank after a predetermined time delay sufficient to remove accumulated slime and mineral deposits.

6. Apparatus as in claim 5 in which said second valve is connected between said carbonated water storage tank and said feeder tank and in which said control means sequentially closes said first valve, opens said third valve, closes said third valve, opens said second valve, closes said second valve, opens said third valve and opens said first valve.

7. Apparatus as in claim 5 in which said control means include a first water level sensing system associated with said feeder tank for operating said first valve normally to maintain water in said icemaker at said predetermined level, means for disabling said first water level sensing system and a second water level sensing system for closing said second valve when the level of carbonated water reaches a second predetermined level above said first level.

* * * * *